US008176750B2

(12) United States Patent
Higashiyama

(10) Patent No.: US 8,176,750 B2
(45) Date of Patent: May 15, 2012

(54) HEAT EXCHANGER

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 498 days.

(21) Appl. No.: 12/458,477

(22) Filed: Jul. 14, 2009

(65) Prior Publication Data

US 2010/0031698 A1 Feb. 11, 2010

(30) Foreign Application Priority Data

Aug. 5, 2008 (JP) ..... 2008-201845

(51) Int. Cl.
*F25B 39/02* (2006.01)

(52) U.S. Cl. ..... 62/515; 62/525

(58) Field of Classification Search ..... 62/515, 62/507, 525, 526; 165/173, 153, 144, 174, 165/175, 176
See application file for complete search history.

(56) References Cited

U.S. PATENT DOCUMENTS

| | | | | |
|---|---|---|---|---|
| 5,157,944 | A * | 10/1992 | Hughes et al. | 62/515 |
| 5,197,538 | A * | 3/1993 | Nagasaka et al. | 165/144 |
| 5,314,013 | A * | 5/1994 | Tanabe | 165/176 |
| 7,275,394 | B2 * | 10/2007 | Lundberg | 62/515 |
| 7,921,558 | B2 * | 4/2011 | Beamer et al. | 29/890.043 |
| 2003/0221819 | A1 * | 12/2003 | Jang | 165/173 |
| 2006/0086486 | A1 * | 4/2006 | Sudo | 165/143 |
| 2006/0137870 | A1 * | 6/2006 | Ohhashi et al. | 165/174 |
| 2006/0236718 | A1 * | 10/2006 | Lundberg | 62/515 |
| 2007/0044949 | A1 * | 3/2007 | Ohashi | 165/176 |
| 2007/0051504 | A1 * | 3/2007 | Ohashi | 165/176 |
| 2007/0084589 | A1 * | 4/2007 | Nishino et al. | 165/152 |
| 2007/0131391 | A1 * | 6/2007 | Ichiyanagi | 165/110 |
| 2007/0144721 | A1 * | 6/2007 | Watanabe et al. | 165/174 |
| 2007/0163766 | A1 * | 7/2007 | Fischer et al. | 165/176 |
| 2007/0251681 | A1 * | 11/2007 | Higashiyama et al. | 165/153 |
| 2008/0028788 | A1 * | 2/2008 | Higashiyama | 62/515 |
| 2008/0041095 | A1 * | 2/2008 | Higashiyama | 62/515 |
| 2008/0115528 | A1 * | 5/2008 | Yamamoto et al. | 62/513 |

FOREIGN PATENT DOCUMENTS

| | | |
|---|---|---|
| JP | 2003-075024 A | 3/2003 |
| JP | 2006-170598 A | 6/2006 |

* cited by examiner

*Primary Examiner* — Mohammad Ali
(74) *Attorney, Agent, or Firm* — Edwards Wildman Palmer LLP

(57) ABSTRACT

An evaporator includes two header tanks and a plurality of heat exchange tubes disposed therebetween. The interior of a refrigerant inlet header section of the first header tank is divided into two spaces by a first flow diverging plate. The heat-exchange-tube-side space of the refrigerant inlet header section is divided into a plurality of sections by a first partition plate. Flow diverging openings are provided in portions of the first flow diverging plate facing the sections. The interiors of first and second intermediate header sections of the second header tank are each divided into sections, equal in number to those of the refrigerant inlet header section.

6 Claims, 6 Drawing Sheets

HEAT EXCHANGER

BACKGROUND OF THE INVENTION

The present invention relates to a heat exchanger which is suitably used as an evaporator of a car air conditioner, which is a refrigeration cycle to be mounted on an automobile, for example.

The present applicant has proposed a heat exchanger which is used as an evaporator of a car air conditioner and which satisfies the requirements for reduction in size and weight and higher performance (refer to Japanese Patent Application Laid-Open (kokai) No. 2003-75024). The heat exchanger includes first and second header tanks disposed apart from each other, and a heat exchange core section provided between the header tanks. In the first header tank, a refrigerant inlet header section having a refrigerant inlet and a refrigerant outlet header section having a refrigerant outlet are juxtaposed in an air flow direction. In the second header tank, a first intermediate header section and a second intermediate header section are juxtaposed in the air flow direction. The first intermediate header section and the second intermediate header section communicate with each other. The heat exchange core section includes a first heat exchange tube row, a second heat exchange tube row, and corrugate fins. The first heat exchange tube row includes a plurality of heat exchange tubes which are separated from one another in the longitudinal direction of the header tanks and whose opposite end portions are connected to the refrigerant inlet header section and the first intermediate header section, respectively. The second heat exchange tube row includes a plurality of heat exchange tubes which are separated from one another in the longitudinal direction of the header tanks and whose opposite end portions are connected to the refrigerant outlet header section and the second intermediate header section, respectively. The corrugate fins are disposed in air-passing clearances, each formed between heat exchange tubes adjacent to each other with respect to the longitudinal direction of the header tanks, and on the outer sides of the heat exchange tubes located at the opposite ends, in such a manner that the corrugate fins are shared by the heat exchange tubes of the first heat exchange tube row and those of the second heat exchange tube row. The corrugate fins are brazed to the heat exchange tubes of the first and second heat exchange tube rows.

In the heat exchanger disclosed in Japanese Patent Application Laid-Open No. 2003-75024, the refrigerant inlet of the refrigerant inlet header section and the refrigerant outlet of the refrigerant outlet header section are formed at the same end portion of the first header tank or in a longitudinal center portion of the first header tank at positions close to each other with respect to the longitudinal direction.

However, through various studies, the present inventor has found that, although the heat exchanger disclosed in Japanese Patent Application Laid-Open No. 2003-75024 usually has a sufficiently high heat exchange performance, when a further improvement of heat exchange performance is required, in some cases the heat exchanger fails to satisfy that requirement. That is, in the case where the refrigerant inlet of the refrigerant inlet header section and the refrigerant outlet of the refrigerant outlet header section are formed at the same end portion of the first header tank or in a longitudinal center portion of the first header tank at positions close to each other with respect to the longitudinal direction, when refrigerant flows from the refrigerant inlet to the refrigerant outlet, a large amount of the refrigerant may flow through heat exchange tubes of the first and second heat exchange tube rows, the heat exchange tubes being located close to the refrigerant inlet and the refrigerant outlet, and the amount of refrigerant flowing through the remaining exchange tubes may decrease, whereby the refrigerant flowing amounts of all the heat exchange tubes become non-uniform. As a result, the temperature of air having passed through the heat exchange core section becomes non-uniform; i.e., varies with location. Thus, the effect of further improving the heat exchange performance of the heat exchanger cannot be attained sufficiently.

In order to solve such a problem, the present applicant has proposed an improvement on the heat exchanger disclosed in Japanese Patent Application Laid-Open No. 2003-75024 (refer to, Japanese Patent Application Laid-Open (kokai) No. 2006-170598). In the improvement, the interior of the refrigerant inlet header section of the first header tank is partitioned into two spaces in the longitudinal direction of the heat exchange tubes by a first diverging flow control wall having a plurality of refrigerant passage holes; the interior of the refrigerant outlet header section of the first header tank is partitioned into two spaces in the longitudinal direction of the heat exchange tubes by a second diverging flow control wall having a plurality of refrigerant passage holes; the interior of the second intermediate header section of the second header tank is partitioned into two spaces in the longitudinal direction of the heat exchange tubes by a third diverging flow control wall having a plurality of refrigerant passage holes; and the interior of the first intermediate header section of the second header tank and the outer section of the second intermediate header section with respect to the longitudinal direction of the heat exchange tubes are connected together at one end portion of the second header tank.

According to the heat exchanger disclosed in Japanese Patent Application Laid-Open No. 2006-170598, diverging flow into all the heat exchange tubes of the two heat exchange tube row occurs uniformly, and the refrigerant flowing amounts of all the heat exchange tubes are rendered uniform, whereby heat exchange performance is improved further.

However, in the case of the heat exchanger disclosed in Japanese Patent Application Laid-Open No. 2006-170598, a large flow passage resistance acts on refrigerant when the refrigerant passes through the refrigerant passage holes of the first through third diverging flow control walls, whereby the heat exchange performance improving effect may be impeded.

SUMMARY OF THE INVENTION

An object of the present invention is to solve the above problem and to provide a heat exchanger which has an improved heat exchange performance.

To fulfill the above object, the present invention comprises the following modes.

1) A heat exchanger comprising first and second header tanks disposed apart from each other; and a plurality of heat exchange tubes which are disposed between the header tanks and whose opposite end portions are connected to the corresponding header tanks, wherein the first header tank includes a refrigerant inlet header section and a refrigerant outlet header section juxtaposed in an air flow direction, the second header tank includes a first intermediate header section and a second intermediate header section juxtaposed in the air flow direction, and the heat exchange tubes establish communication between the refrigerant inlet header section and the first intermediate header section and communication between the refrigerant outlet header section and the second intermediate header section, wherein a portion of the interior of the refrigerant inlet header section, the portion communicating with the heat exchange tubes, is divided into a plurality of sections in a longitudinal direction of the header tanks;

flow diverging means is provided in the refrigerant inlet header section so as to cause refrigerant having flowed into the refrigerant inlet header section to diverge into the sections;

each of the interiors of the first intermediate header section and the second intermediate header section is divided into sections in the longitudinal direction of the header tanks, the number of the sections being equal to the number of the sections of the refrigerant inlet header section;

the heat exchange tubes communicating with the sections of the refrigerant inlet header section communicate with the corresponding sections of the first intermediate header section; and the sections of the first intermediate header section communicate with the corresponding sections of the second intermediate header section.

2) A heat exchanger according to par. 1), wherein the interior of the refrigerant inlet header section is divided into two spaces in the longitudinal direction of the heat exchange tubes by an inlet header section flow diverging member; a first space of the refrigerant inlet header section located on a side toward the heat exchange tubes serves as the portion communicating with the heat exchange tubes; the first space is divided into a plurality of sections in the longitudinal direction of the header tanks by an inlet header section partition member; refrigerant flows into a second space of the refrigerant inlet header section located on a side opposite the heat exchange tubes; and flow diverging means composed of a flow diverging opening is provided in each of portions of the inlet header section flow diverging member corresponding to the sections of the first space so as to cause the refrigerant having flowed into the second space of the refrigerant inlet header section to diverge into the corresponding spaces.

3) A heat exchanger according to par. 1), wherein each of the sections of the second intermediate header section of the second header tank is divided into two spaces in the longitudinal direction of the heat exchange tubes by a second intermediate header section flow diverging member, and communication is established between the two spaces of each section.

4) A heat exchanger according to par. 1), wherein the interior of the refrigerant outlet header section of the first header tank is divided into two spaces in the longitudinal direction of the heat exchange tubes by an outlet header section flow diverging member; a space of the refrigerant outlet header section located on a side toward the heat exchange tubes serves a portion communicating with the heat exchange tubes; the space located on the side toward the heat exchange tubes is divided into a plurality of sections in the longitudinal direction of the header tanks by an outlet header section partition member, the number of sections being equal to the number of sections of the refrigerant inlet header section; and the sections of the space located on the side toward the heat exchange tubes communicate with a space of the refrigerant outlet header section located on a side opposite the heat exchange tubes.

5) A heat exchanger according to par. 1), wherein each of the number of the sections of the refrigerant inlet header section of the first header tank, the number of the sections of the first intermediate header section of the second header tank, and the number of the sections of the second intermediate header section of the second header tank is two; the sections of the first intermediate header section and the second intermediate header section located on one side with respect to the longitudinal direction of the header tanks communicate with each other via a communication portion provided at one end of the second header tank; and the sections of the first intermediate header section and the second intermediate header section located on the other side with respect to the longitudinal direction of the header tanks communicate with each other via a communication portion provided at the other end of the second header tank.

6) A heat exchanger according to par. 1), wherein the interior of the second header tank is divided into two spaces in the air flow direction by a partition member so that the first intermediate header section and the second intermediate header section are formed; and refrigerant passage holes are formed in the partition member so as to establish communication between the first intermediate header section and the second intermediate header section.

According to the heat exchanger of par. 1), a portion of the interior of the refrigerant inlet header section, the portion communicating with the heat exchange tubes, is divided into a plurality of sections in the longitudinal direction of the header tanks; flow diverging means is provided in the refrigerant inlet header section so as to cause refrigerant having flowed into the refrigerant inlet header section to diverge into the sections; each of the interiors of the first intermediate header section and a second intermediate header section is divided into sections in the longitudinal direction of the header tanks, the number of the sections being equal to the number of the sections of the refrigerant inlet header section; the heat exchange tubes communicating with the sections of the refrigerant inlet header section communicate with the corresponding sections of the first intermediate header section; and the sections of the first intermediate header section of the second header tank communicate with the corresponding sections of the second intermediate header section of the second header tank. Therefore, refrigerant caused by the flow diverging means to diverge into the sections of the refrigerant inlet header section flows through the heat exchange tubes into the corresponding sections of the first intermediate header section, enters the corresponding sections of the second intermediate header section, flows through the heat exchange tubes into the refrigerant outlet header section, and flows out from the refrigerant outlet. Therefore, the amount of refrigerant flowing from each section of the second intermediate header section to the refrigerant outlet header section is always equal to the amount of refrigerant flowing from each section of the refrigerant inlet header section to the corresponding section of the first intermediate header section. As a result, the diverging flow into all the heat exchange tubes is performed uniformly, and the refrigerant flow amounts of all the heat exchange tubes are made uniform, whereby heat exchange performance is improved further. Moreover, unlike the heat exchanger disclosed in Japanese Patent Application Laid-Open No. 2006-170598, the heat exchanger of par. 1) does not require first through third diverging flow control walls. Therefore, the channel resistance which acts on refrigerant upon passage through the heat exchanger can be reduced, whereby an excellent effect of improving the heat exchange performance is attained.

Further, according to an evaporator to which the heat exchanger of par. 1) is applied, even when air passing through the evaporator produces a relatively large difference in flow speed between one end and the other end with respect to the longitudinal direction of the header tanks, a change in the temperature of air having passed through the evaporator with respect to the longitudinal direction of the header tanks can be reduced. When air passing through the evaporator disclosed in Japanese Patent Application Laid-Open No. 2003-75024 produces a relatively large difference in flow speed between one end and the other end with respect to the longitudinal direction of the header tanks, the following phenomenon occurs. That is, on the side where the air flow speed is large, refrigerant is likely to vaporize, so that a large amount of vapor-phase refrigerant flows through the heat exchange tubes and receives a large resistance. In contrast, on the side where the air flow speed is small, a large amount of liquid-phase refrigerant flows through the heat exchange tube. Therefore, the temperature of air having passed through the evaporator also becomes non-uniform with respect to the longitudinal direction of the header tanks. However, in the case of the evaporator to which the heat exchanger of par. 1) is applied, even when air passing through the evaporator produces a relatively large difference in flow speed between one end and the other end with respect to the longitudinal direction of the header tanks, air passing through each of areas corresponding to the extents of the respective sections of the refrigerant inlet header section, the first intermediate header section, and the second intermediate header section does not produce a large difference in flow speed between one end and the other end of the corresponding area with respect to the longitudinal direction of the header tanks. Accordingly, the amounts of refrigerant flowing through the heat exchange tubes located in the area corresponding to the extent of each section is rendered uniform, whereby a change in the temperature of air having passed through the evaporator with respect to the longitudinal direction of the header tanks can be reduced.

Moreover, according to the evaporator to which the heat exchanger of par. 1) is applied, even when the flow speed of air passing through the evaporator changes relatively greatly depending on the position with respect to the longitudinal direction of the header tanks; that is, the flow speed of air passing through each of areas corresponding to the extents of the respective sections of the refrigerant inlet header section, the first intermediate header section, and the second intermediate header section differs relatively greatly among the areas corresponding to the extents of the respective sections, the flow of refrigerant flowing through the heat exchange tubes which communicate with the sections corresponding to a region where the air-flow speed is low becomes unlikely to receive the influence of the flow of refrigerant flowing through the heat exchange tubes which communicate with the sections corresponding to a region where the air-flow speed is high. Thus, in each of regions corresponding to the heat exchange tubes which communicate with the respective sections, the temperature of air having passed through the evaporator is made uniform in the longitudinal direction of the respective sections. Accordingly, a change in the temperature of air having passed through the evaporator with respect to the longitudinal direction of the header tanks can be reduced.

According to the heat exchanger of par. 2), the refrigerant flowing amounts of all the heat exchange tubes can be rendered more uniform, as compared with the heat exchanger of par. 1).

According to the heat exchanger of par. 3), the refrigerant flowing amounts of all the heat exchange tubes can be rendered more uniform, as compared with the heat exchanger of par. 1).

According to the heat exchanger of par. 4), the refrigerant flowing amounts of all the heat exchange tubes can be rendered more uniform, as compared with the heat exchanger of par. 1).

According to the heat exchanger of par. 5), through adjustment of the sectional areas of flow passages of the communication portions, the amount of refrigerant flowing through one section of the refrigerant inlet header section of the first header tank, one section of the first intermediate header section of the second header tank, and one section of the second intermediate header section of the second header tank can be made equal to the amount of refrigerant flowing through the other section of the refrigerant inlet header section of the first header tank, the other section of the first intermediate header section of the second header tank, and the other section of the second intermediate header section of the second header tank. Accordingly, the diverging flow into all the heat exchange tubes is performed uniformly, and the refrigerant flow amounts of all the heat exchange tubes are made uniform, whereby heat exchange performance is improved further.

According to the heat exchanger of par. 6), since a flow path through which refrigerant flows can be shortened, the flow passage resistance can be reduced.

DESCRIPTION OF THE PREFERRED EMBODIMENTS

Figure 1:
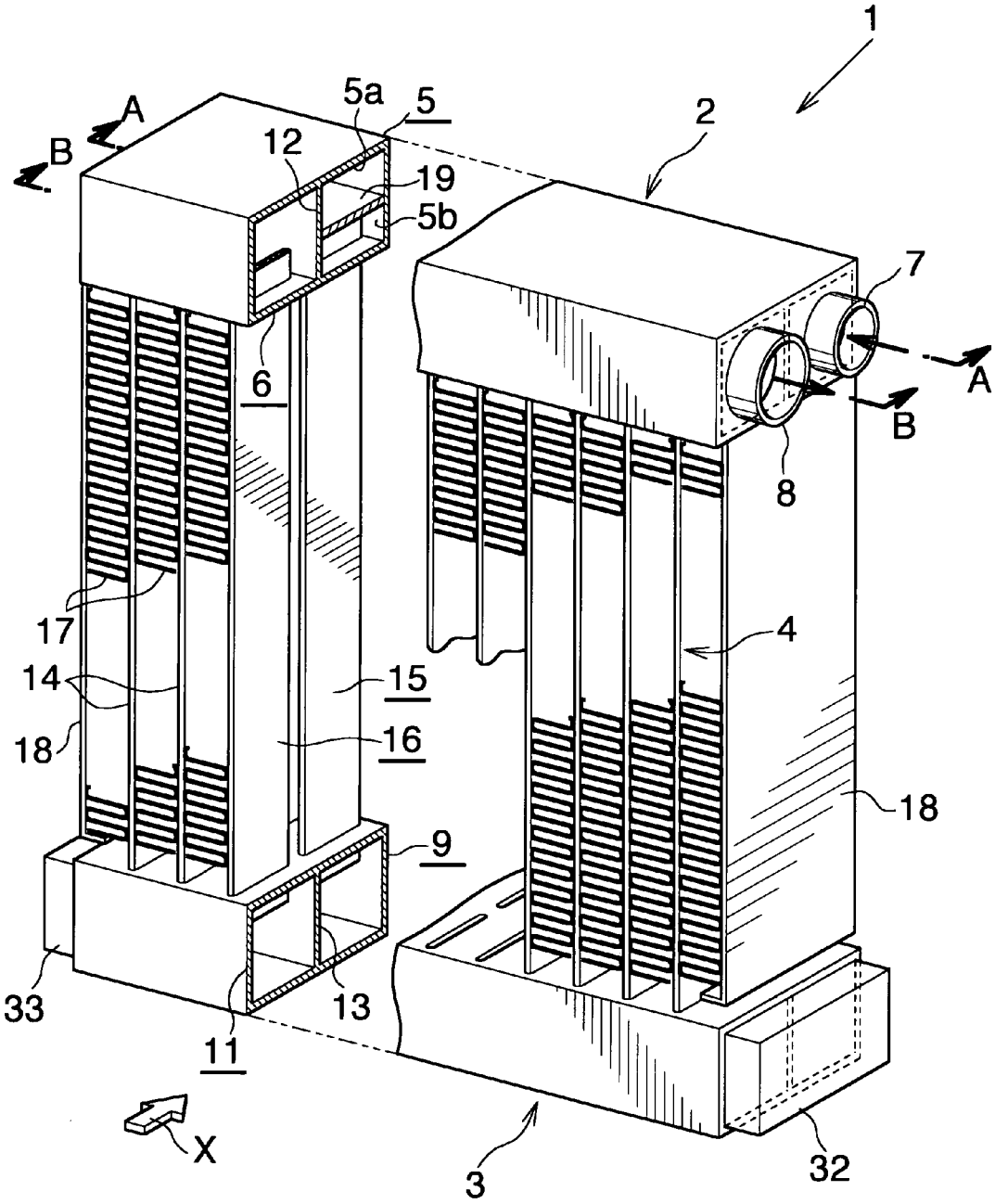
FIG. 1 is a partially cut-away perspective view showing the overall structure of a first embodiment of an evaporator to which a heat exchanger according to the present invention is applied.

Preferred embodiments of the present invention will next be described with reference to the drawings. The embodiments are implemented by applying a heat exchanger according to the present invention to an evaporator of a car air conditioner using a chlorofluorocarbon-based refrigerant.

Notably, in the following description, the term "aluminum" encompasses aluminum alloys in addition to pure aluminum.

In the following description, the downstream side (a direction represented by arrow X in FIG. 1) of an air flow through air-passing clearances between adjacent heat exchange tubes will be referred to as the "front," and the opposite side as the "rear," and the upper, lower, left-hand, and right-hand sides of the drawings will be referred to as "upper," "lower," "left," and "right," respectively.

Further, identical portions and identical members are denoted by the same reference numerals throughout the drawings, and redundant descriptions are eliminated.

First Embodiment

The present embodiment is shown in FIGS. 1 and 2, which show the overall configuration of an evaporator.

As shown in FIG. 1, an evaporator 1 includes a first header tank 2 and a second header tank 3, which are formed of aluminum and are disposed apart from each other in the vertical direction, and a heat exchange core section 4 provided between the first and second header tanks 2 and 3.

The first header tank 2 includes a refrigerant inlet header section 5 located on the front side (downstream side with respect to the air flow direction), and a refrigerant outlet header section 6 located on the rear side (upstream side with respect to the air flow direction) and integrated with the refrigerant inlet header section 5. A refrigerant inlet 7 is provided in a right end portion of the refrigerant inlet header section 5, and a refrigerant outlet 8 is provided in a right end portion of the refrigerant outlet header section 6. The second header tank 3 includes a first intermediate header section 9 located on the front side, and a second intermediate header section 11 located on the rear side and integrated with the first intermediate header section 9. In the present embodiment, the refrigerant inlet header section 5 and the refrigerant outlet header section 6 are formed by partitioning the interior of the first header tank 2 by means of a vertical partition wall 12, and the first intermediate header section 9 and the second intermediate header section 11 are formed by partitioning the interior of the second header tank 3 by means of a vertical partition wall 13.

The heat exchange core section 4 is configured as follows. Heat exchange tube rows 15 and 16 are arranged in a plurality of; herein, two, rows in the front-rear direction. Each of the heat exchange tube rows 15 and 16 is composed of a plurality of flat heat exchange tubes 14, which are made of aluminum, are arranged at predetermined intervals in the left-right direction, and extend in the vertical direction. Corrugated fins 17 made of aluminum are disposed within corresponding air-passing clearances between the adjacent heat exchange tubes 14 of the heat exchange tube rows 15 and 16 and externally of the left-end and right-end heat exchange tubes 14 of the heat exchange tube rows 15 and 16 in such a manner that the corrugated fins 17 face both the exchange tubes 14 of the front heat exchange tube rows 15 and those of the rear heat exchange tube row 16. The corrugated fins 17 are brazed to the exchange tubes 14 of the heat exchange tube rows 15 and 16. Side plates 18 made of aluminum are disposed externally of the left-end and right-end corrugated fins 17 and are brazed to the corresponding corrugated fins 17.

The heat exchange tubes 14 of the front heat exchange tube row 15 are disposed between the refrigerant inlet header section 5 of the first header tank 2 and the first intermediate header section 9 of the second header tank 3; and upper and lower end portions of the heat exchange tubes 14 of the front heat exchange tube row 15 are connected to the refrigerant inlet header section 5 and the first intermediate header section 9, respectively. The heat exchange tubes 14 of the rear heat exchange tube row 16 are disposed between the refrigerant outlet header section 6 of the first header tank 2 and the second intermediate header section 11 of the second header tank 3; and upper and lower end portions of the heat exchange tubes 14 of the rear heat exchange tube row 16 are connected to the refrigerant outlet header section 6 and the second intermediate header section 11, respectively.

Figure 2B:
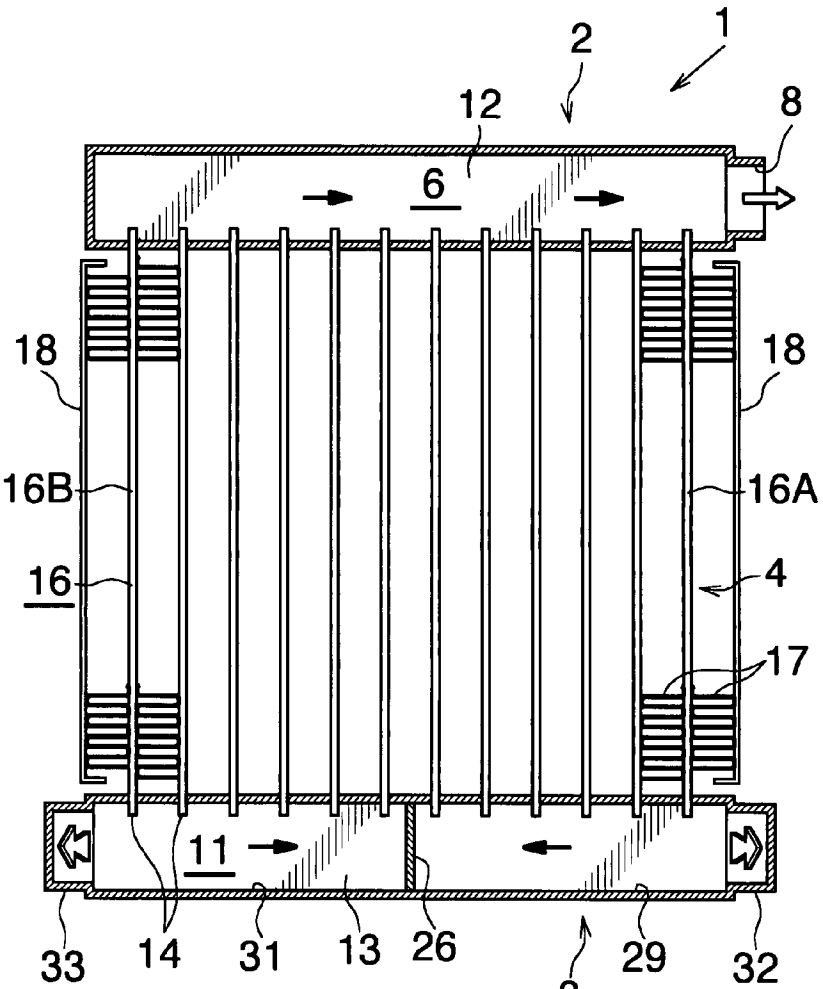
FIG. 2*b* is a partially-omitted cross sectional view taken along line B-B of FIG. 1.
Figure 2A:
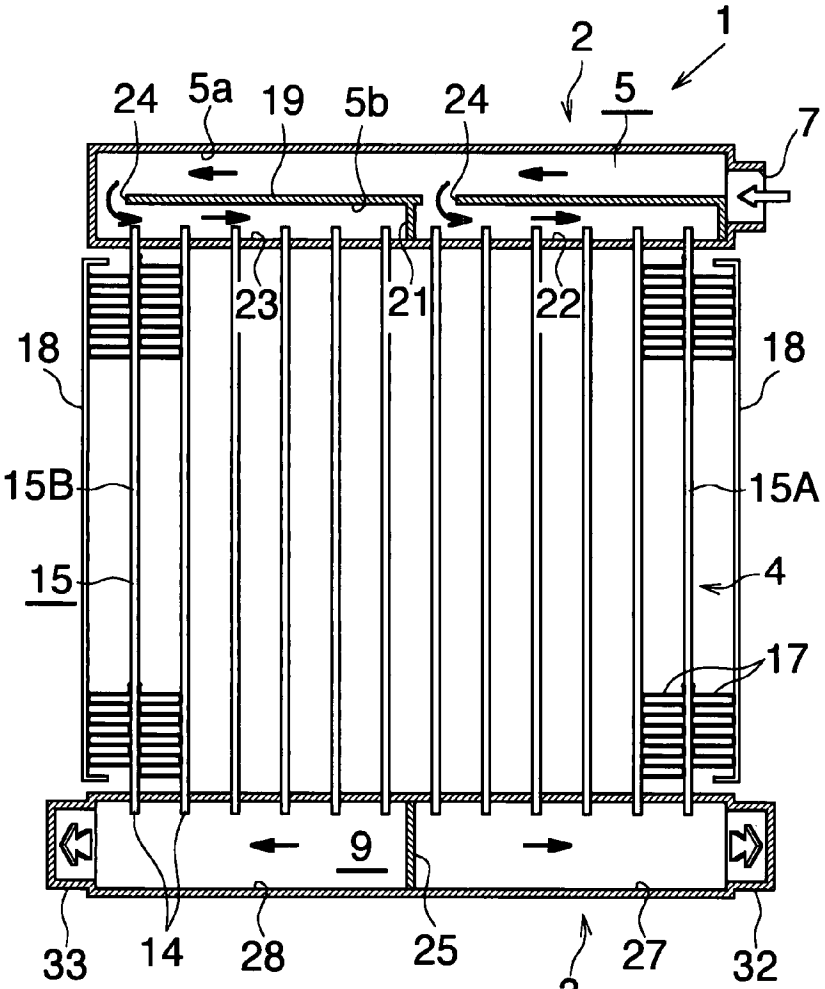
FIG. 2*a* is a partially-omitted cross sectional view taken along line A-A of FIG. 1.

As shown in FIGS. 2*a* and 2*b*, the interior of the refrigerant inlet header section 5 of the first header tank 2 is divided into two spaces 5*a* and 5*b* in the vertical direction by a first horizontal flow diverging plate 19 (an inlet header section flow diverging member). Notably, the refrigerant inlet 7 communicates with the upper space 5*a*. The lower space 5*b* of the refrigerant inlet header section 5 (a space on the side toward the heat exchange tubes 14), which communicates with the heat exchange tubes 14, is divided into a plurality of (in the present embodiment, two) sections 22 and 23 in the left-right direction (the longitudinal direction of the first header tank 2) by a first vertical partition plate 21 (an inlet header section partition member). Flow diverging means, which is constituted by a flow diverging opening 24 assuming the form of a through hole, is provided at the left ends (the downstream ends with respect to the refrigerant flow direction) of portions of the first flow diverging plate 19, the portions facing the sections 22 and 23, so as to cause the refrigerant having flowed into the upper space 5*a* of the refrigerant inlet header section 5 to diverge into the sections 22 and 23.

The interiors of the first intermediate header section 9 and the second intermediate header section 11 of the second header tank 3 are respectively divided into sections 27 and 28 and sections 29 and 31, which are the same in number as the sections 22 and 23 of the refrigerant inlet header section 5, in the left-right direction (the longitudinal direction of the first header tank 2) by second and third vertical partition plates 25 and 26 (a first intermediate header section partition member and a second intermediate header section partition member), respectively. The length (as measured in the left-right direction) of the sections 27, 28, 29, and 31 within the first intermediate header section 9 and the second intermediate header section 11 is equal to the length (as measured in the left-right direction) of the sections 22 and 23 within the lower space 5*b* of the refrigerant inlet header section 5. The heat exchange tubes 14 which communicate with the sections 22 and 23 of the lower space 5*b* of the refrigerant inlet header section 5 communicate with the sections 27 and 28 within the first intermediate header section 9. The right-side sections 27 and 29 (located on one side with respect to the longitudinal direction of the header tanks) of the first intermediate header section 9 and the second intermediate header section 11 communicate with each other via a communication portion 32 provided at the right end of the second header tank 3; and the left-side sections 28 and 31 (located on the other side with respect to the longitudinal direction of the header tanks) of the first intermediate header section 9 and the second intermediate header section 11 communicate with each other via a communication portion 33 provided at the left end of the second header tank 3.

The heat exchange tubes 14 which constitute the front heat exchange tube row 15 are divided into a first heat exchange tube group 15A which communicates with the right-side section 22 of the refrigerant inlet header section 5 of the first header tank 2 and the right-side section 27 of the first intermediate header section 9 of the second header tank 3, and a second heat exchange tube group 15B which communicates with the left-side section 23 of the refrigerant inlet header section 5 of the first header tank 2 and the left-side section 28 of the first intermediate header section 9 of the second header tank 3. Further, the heat exchange tubes 14 which constitute the rear heat exchange tube row 16 are divided into a third heat exchange tube group 16A which is composed of the heat exchange tubes 14 which are disposed on the rear side of the heat exchange tubes 14 of the first heat exchange tube group 15A and which communicate with the right-side section 29 of the second intermediate header section 11 of the second header tank 3, and a fourth heat exchange tube group 16B which is composed of the heat exchange tubes 14 which are disposed on the rear side of the heat exchange tubes 14 of the second heat exchange tube group 15B and which communicate with the left-side section 31 of the second intermediate header section 11 of the second header tank 3.

The above-described evaporator 1, together with a compressor and a condenser serving as a refrigerant cooler, constitutes a refrigeration cycle which uses a chlorofluorocarbon-based refrigerant. This refrigeration cycle is installed in a vehicle, such as an automobile, as a car air conditioner. A two-phase refrigerant of vapor-liquid phase having passed through the compressor, the condenser, and an expansion valve flows through the refrigerant inlet 7 and enters the upper space 5*a* of the refrigerant inlet header section 5 of the first header tank 2. In the upper space 5*a* of the refrigerant inlet header section 5, the refrigerant flows leftward, and enters the sections 22 and 23 of the lower space 5*b* via the diverging openings 24.

In the spaces 22 and 23 of the lower space 5*b* of the refrigerant inlet header section 5, the refrigerant diverges into the heat exchange tubes 14 of the heat exchange tube groups 15A and 15B of the front heat exchange tube row 15. The refrigerant then flows downward within the heat exchange tubes 14 and enters the sections 27 and 28 of the first intermediate header section 9 of the second header tank 3. The refrigerant having entered the right-side section 27 of the first intermediate header section 9 flows rightward and enters the right-side section 29 of the second intermediate header section 11 via the communication portion 32 at the right end. Meanwhile, the refrigerant having entered the left-side section 28 of the first intermediate header section 9 flows leftward and enters the left-side section 31 of the second intermediate header section 11 via the communication portion 33 at the left end.

The refrigerant having entered the sections 29 and 31 of the second intermediate header section 11 diverges and flows into the heat exchange tubes 14 of the heat exchange tube groups 16A and 16B of the rear heat exchange tube row 16. The refrigerant then flows upward within the heat exchange tubes 14 and enters the refrigerant outlet header section 6 of the first header tank 2. The refrigerant having entered the refrigerant outlet header section 6 flows rightward and flows to the outside via the refrigerant outlet 8.

While flowing through the heat exchange tubes 14 of the front heat exchange tube row 15 and the heat exchange tubes 14 of the rear heat exchange tube row 16, the refrigerant is subjected to heat exchange with air flowing through the air-passing clearances of the heat exchange core section 4 (see arrow X of FIG. 1). Then, the refrigerant flows out from the evaporator in a vapor phase.

At that time, the amount of refrigerant flowing from each of the sections 29 and 31 of the second intermediate header section 11 to the refrigerant outlet header section 6 is always equal to the amount of refrigerant flowing from each of the sections 22 and 23 of the refrigerant inlet header section 5 to the corresponding section 27 or 28 of the first intermediate header section 9. That is, the total amount of refrigerant flowing through the heat exchange tubes 14 which constitute the third heat exchange tube group 16A of the rear heat exchange tube row 16 is equal to the total amount of refrigerant flowing through the heat exchange tubes 14 which constitute the first heat exchange tube group 15A of the front heat exchange tube row 15; and the total amount of refrigerant flowing through the heat exchange tubes 14 which constitute the fourth heat exchange tube group 16B of the rear heat exchange tube row 16 is equal to the total amount of refrigerant flowing through the heat exchange tubes 14 which constitute the second heat exchange tube group 15B of the front heat exchange tube row 15. As a result, the diverging flow into all the heat exchange tubes 14 is performed uniformly, and the refrigerant flow amounts of all the heat exchange tubes 14 are rendered uniform, whereby heat exchange performance is improved.

Further, even when air passing through the evaporator 1 produces a relatively large difference in flow speed between one end and the other end with respect to the left-right direction, air passing through each of areas corresponding to the extents (with respect to the left-right direction) of the respective sections 22, 23, 27, 28, 29, and 31 of the refrigerant inlet header section 5, the first intermediate header section 9, and the second intermediate header section 11 does not produce a large difference in flow speed between one end and the other end of each of the areas corresponding to the extents of the respective sections 22, 23, 27, 28, 29, and 31. That is, air passing through the air-passing clearances between the adjacent heat exchange tubes 14 of the first heat exchange tube group 15A of the front heat exchange tube row 15 and the third heat exchange tube group 16A of the rear heat exchange tube row 16 and air passing through the air-passing clearances between the adjacent heat exchange tubes 14 of the second heat exchange tube group 15B of the front heat exchange tube row 15 and the fourth heat exchange tube group 16B of the rear heat exchange tube row 16 do not produce a large difference in flow speed between one end and the other end of each of the areas corresponding to the extents of the respective sections 22, 23, 27, 28, 29, and 31. Accordingly, all the amounts of refrigerant flowing through the heat exchange tubes 14 located in the areas corresponding the extents of the respective sections 22, 23, 27, 28, 29, and 31; that is, all the flow amounts of refrigerant flowing through the heat exchange tubes 14 which constitute the first heat exchange tube group 15A of the front heat exchange tube row 15, all the flow amounts of refrigerant flowing through the heat exchange tubes 14 which constitute the third heat exchange tube group 16A of the rear heat exchange tube row 16, all the flow amounts of refrigerant flowing through the heat exchange tubes 14 which constitute the second heat exchange tube group 15B of the front heat exchange tube row 15, and all the flow amounts of refrigerant flowing through the heat exchange tubes 14 which constitute the fourth heat exchange tube group 16B of the rear heat exchange tube row 16, are respectively made uniform, whereby a change in the temperature of air having passed through the evaporator 1 with respect to the left-right direction can be reduced.

Moreover, in some cases, the flow speed of air passing through the areas corresponding to the extents of the respective sections 22, 23, 27, 28, 29, and 31 of the refrigerant inlet header section 5, the first intermediate header section 9, and the second intermediate header section 11 differ relatively greatly among the areas corresponding to the extents of the respective sections 22, 23, 27, 28, 29, and 31; that is, the flow speed of air passing through the air-passing clearances between the adjacent heat exchange tubes 14 of the first heat exchange tube group 15A of the front heat exchange tube row 15 and the third heat exchange tube group 16A of the rear heat exchange tube row 16 differs relatively greatly from the flow speed of air passing through the air-passing clearances between the adjacent heat exchange tubes 14 of the second heat exchange tube group 15B of the front heat exchange tube row 15 and the fourth heat exchange tube group 16B of the rear heat exchange tube row 16. Even in such a case, the flow of refrigerant flowing through the heat exchange tubes 14 of the heat exchange tube groups which communicate with the sections corresponding to a region where the air-flow speed is low becomes unlikely to receive the influence of the flow of refrigerant flowing through the heat exchange tubes 14 of the heat exchange tube groups which communicate with the sections corresponding to a region where the air-flow speed is high. Thus, in each of regions corresponding to the heat exchange tubes 14 of the heat exchange tube groups which communicate with the respective sections 22, 23, 27, 28, 29, and 31, the temperature of air having passed through the evaporator 1 is made uniform in the longitudinal direction of the respective sections 22, 23, 27, 28, 29, and 31. Accordingly, a change in the temperature of air having passed through the evaporator 1 with respect to the left-right direction can be reduced.

Second Embodiment

Figure 3B:
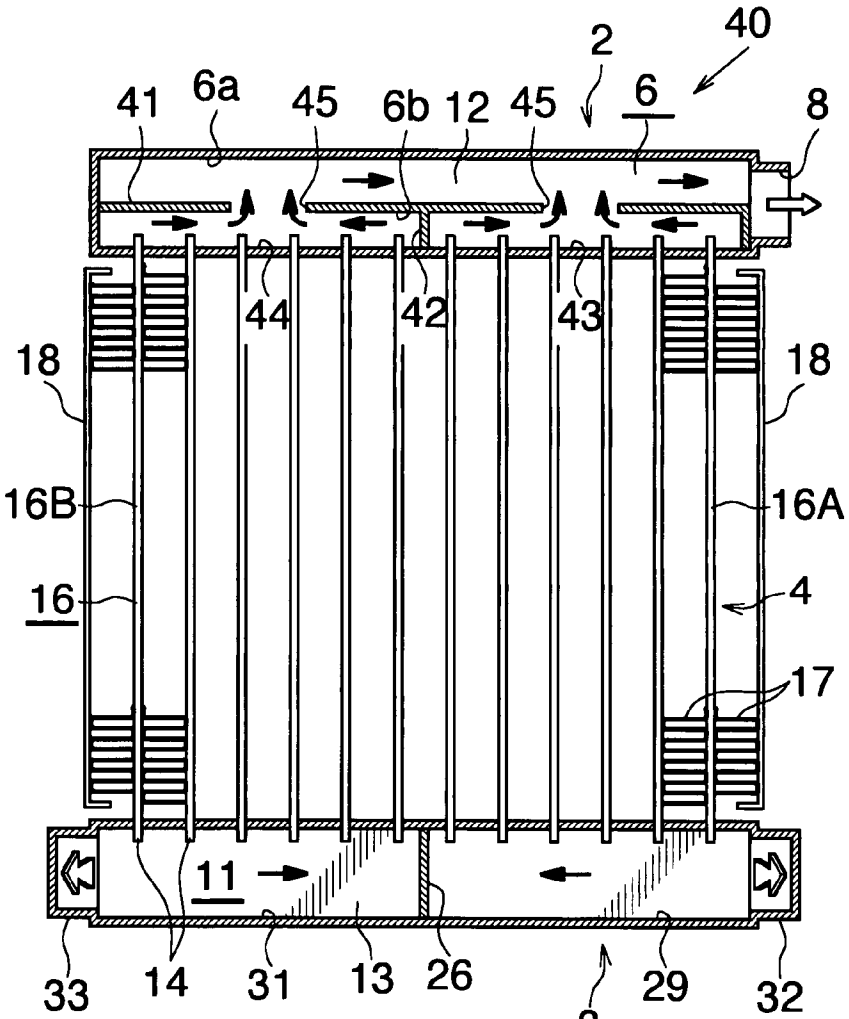
FIG. 3*b* is a view corresponding to FIG. 2*b* and showing the overall structure of the second embodiment of the evaporator to which the heat exchanger according to the present invention is applied.
Figure 3A:
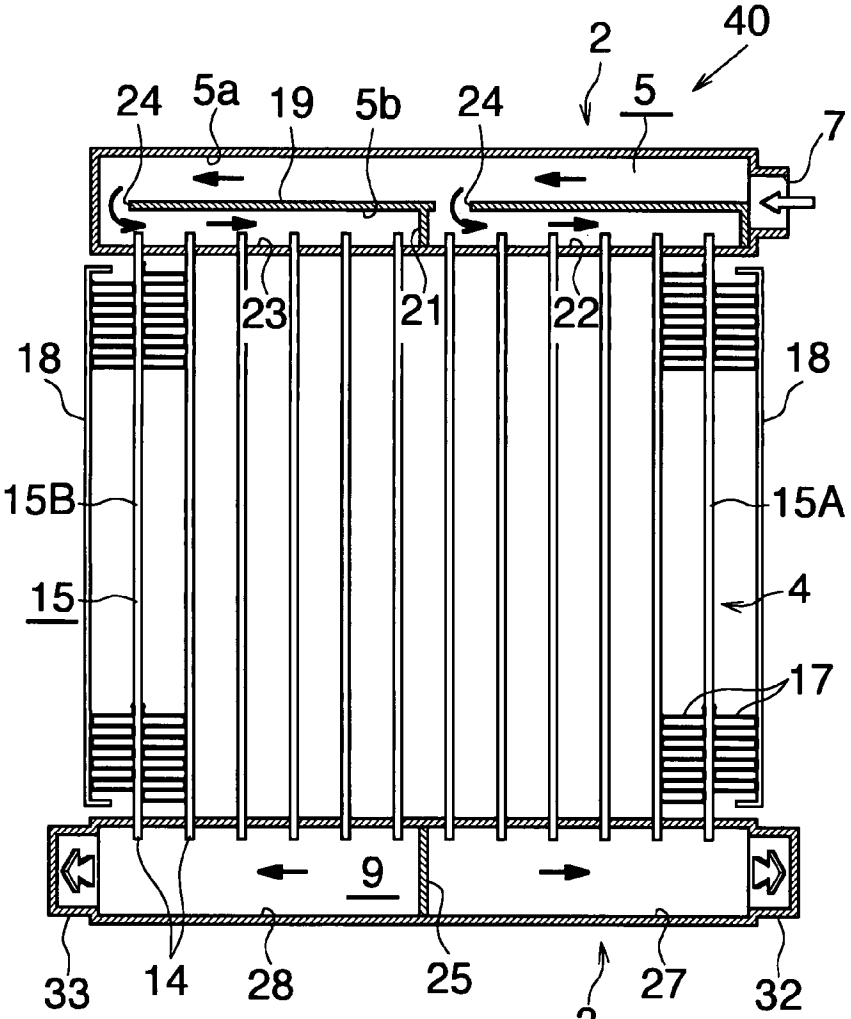
FIG. 3*a* is a view corresponding to FIG. 2*a* and showing the overall structure of a second embodiment of the evaporator to which the heat exchanger according to the present invention is applied.

The present embodiment is shown in FIGS. 3*a* and 3*b*, which show the entire structure of an evaporator.

In the case of the evaporator 40 shown in FIGS. 3*a* and 3*b*, the interior of the refrigerant outlet header section 6 of the first header tank 2 is divided into two spaces 6*a* and 6*b* in the vertical direction (the longitudinal direction of the heat exchange tubes 14) by a second horizontal flow diverging plate 41 (an outlet header section flow diverging member). Notably, the refrigerant outlet 8 communicates with the upper space 6*a*. The lower space 6*b* of the refrigerant outlet header section 6 (a space on the side toward the heat exchange tubes 14), which communicates with the heat exchange tubes 14, is divided into sections 43 and 44 in the left-right direction (the longitudinal direction of the first header tank 2) by a second vertical partition plate 42 (an outlet header section partition member). The sections 43 and 44 are equal in number to the sections 22 and 23 of the refrigerant inlet header section 5. Further, communication holes 45 are formed in portions of the second flow diverging plate 41, the portions facing the sections 43 and 44, so as to establish communication between the sections 43 and 44 and the upper space 6*a* of the refrigerant outlet header section 6.

The heat exchange tubes 14 of the third heat exchange tube group 16A communicate with the right-side section 43 of the refrigerant outlet header section 6, and the heat exchange tubes 14 of the fourth heat exchange tube group 16B communicate with the left-side section 44 of the refrigerant outlet header section 6.

Except for the above-described structural feature, the evaporator 40 is identical with the evaporator 1 of the first embodiment.

Third Embodiment

Figure 4B:
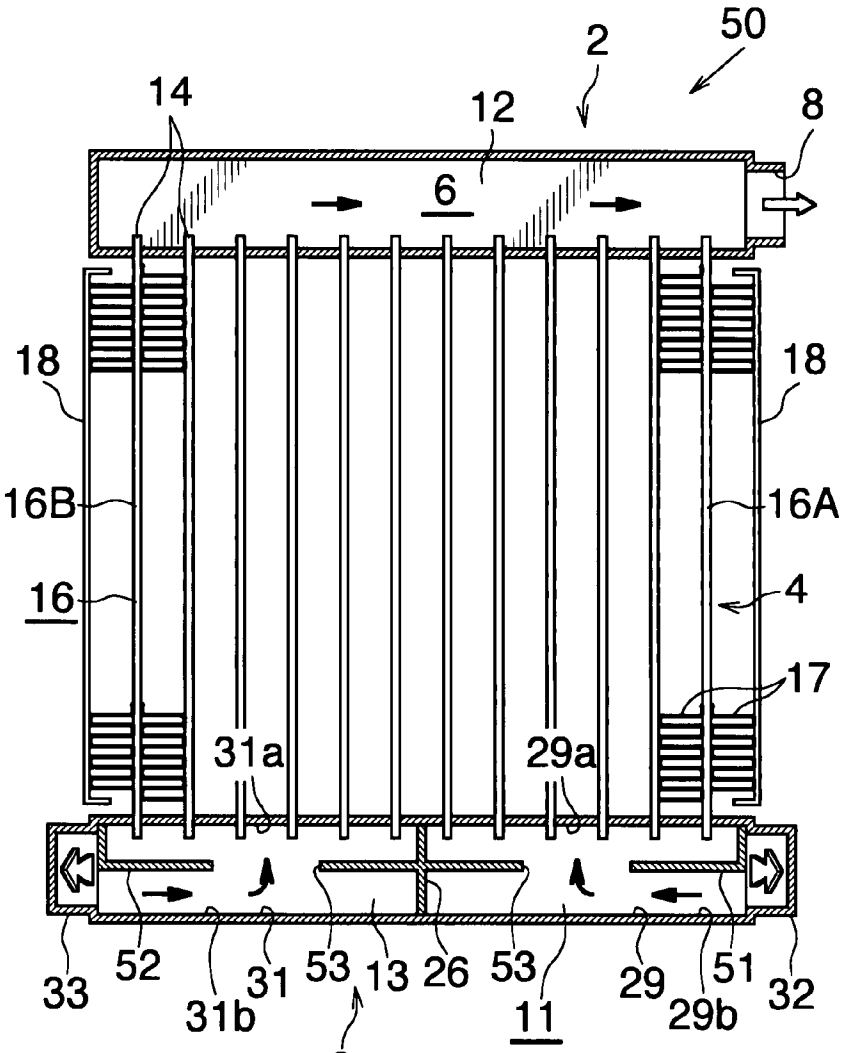
FIG. 4*b* is a view corresponding to FIG. 2*b* and showing the overall structure of the third embodiment of the evaporator to which the heat exchanger according to the present invention is applied.
Figure 4A:
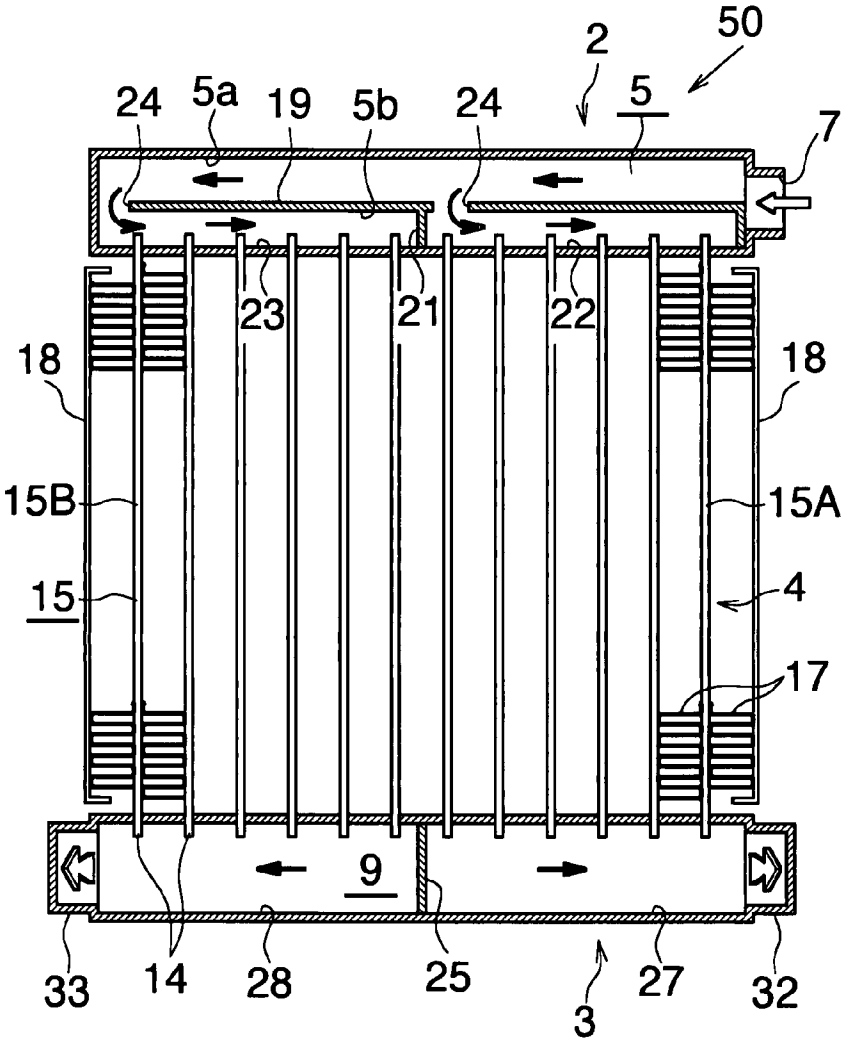
FIG. 4*a* is a view corresponding to FIG. 2*a* and showing the overall structure of a third embodiment of the evaporator to which the heat exchanger according to the present invention is applied.

The present embodiment is shown in FIGS. 4*a* and 4*b*, which show the entire structure of an evaporator.

In the case of the evaporator 50 shown in FIGS. 4*a* and 4*b*, the interiors of the sections 29 and 31 of the second intermediate header section 11 of the second header tank 3 are divided into two spaces 29*a* and 29*b* and two spaces 31*a* and 31*b*, respectively, in the vertical direction (the longitudinal direction of the heat exchange tubes 14) by third horizontal flow diverging plates 51 and 52 (second intermediate header section flow diverging members). Communication holes 53 are formed in the third flow diverging plates 51 and 52 so as to establish communication between the upper space 29*a* and the lower space 29*b* of the section 29 and between the upper space 31*a* and the lower space 31*b* of the section 31. The communication portion 32 at the right end establishes communication between the right-side section 27 of the first intermediate header section 9 and the lower space 29*b* of the right-side section 29 of the second intermediate header section 11. Further, the communication portion 33 at the left end establishes communication between the left-side section 28 of the first intermediate header section 9 and the lower space 31*b* of the left-side section 31 of the second intermediate header section 11.

The heat exchange tubes 14 of the third heat exchange tube group 16A communicate with the upper space 29*a* of the right-side section 29 of the second intermediate header section 11, and the heat exchange tubes 14 of the fourth heat exchange tube group 16B communicate with the upper space 31*a* of the left-side section 31 of the second intermediate header section 11.

Except for the above-described structural feature, the evaporator 50 is identical with the evaporator 1 of the first embodiment.

Fourth Embodiment

Figure 5B:
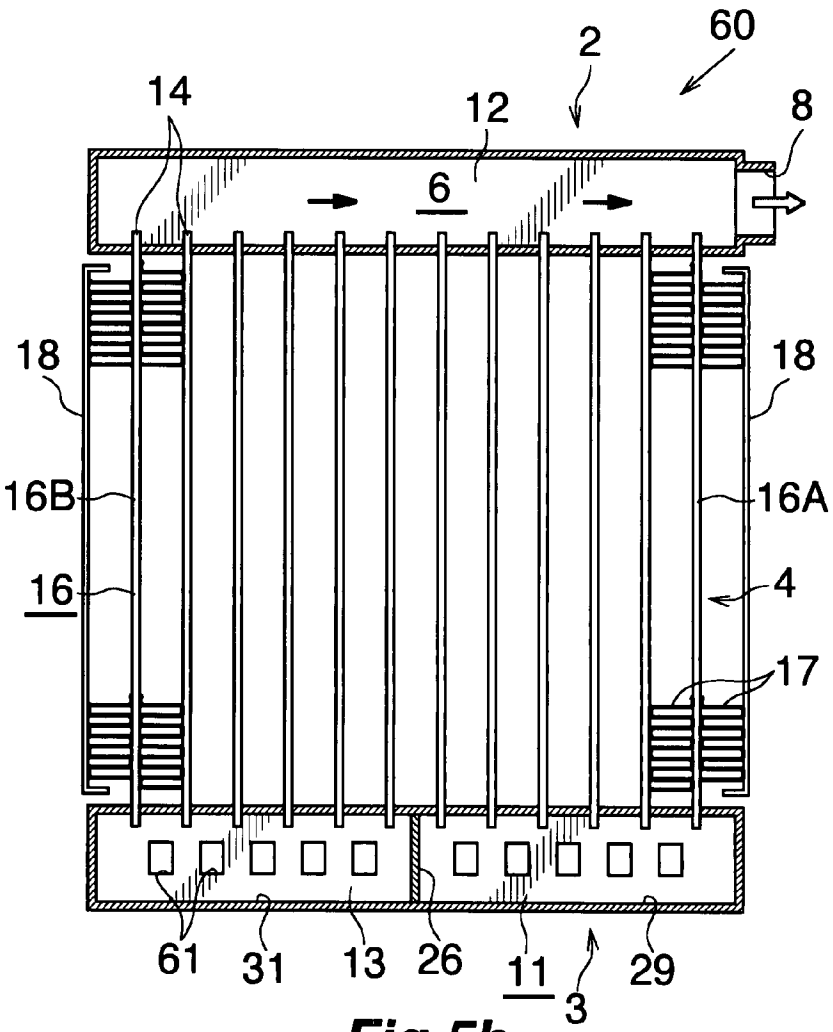
FIG. 5*b* is a view corresponding to FIG. 2*b* and showing the overall structure of the fourth embodiment of the evaporator to which the heat exchanger according to the present invention is applied.
Figure 5A:
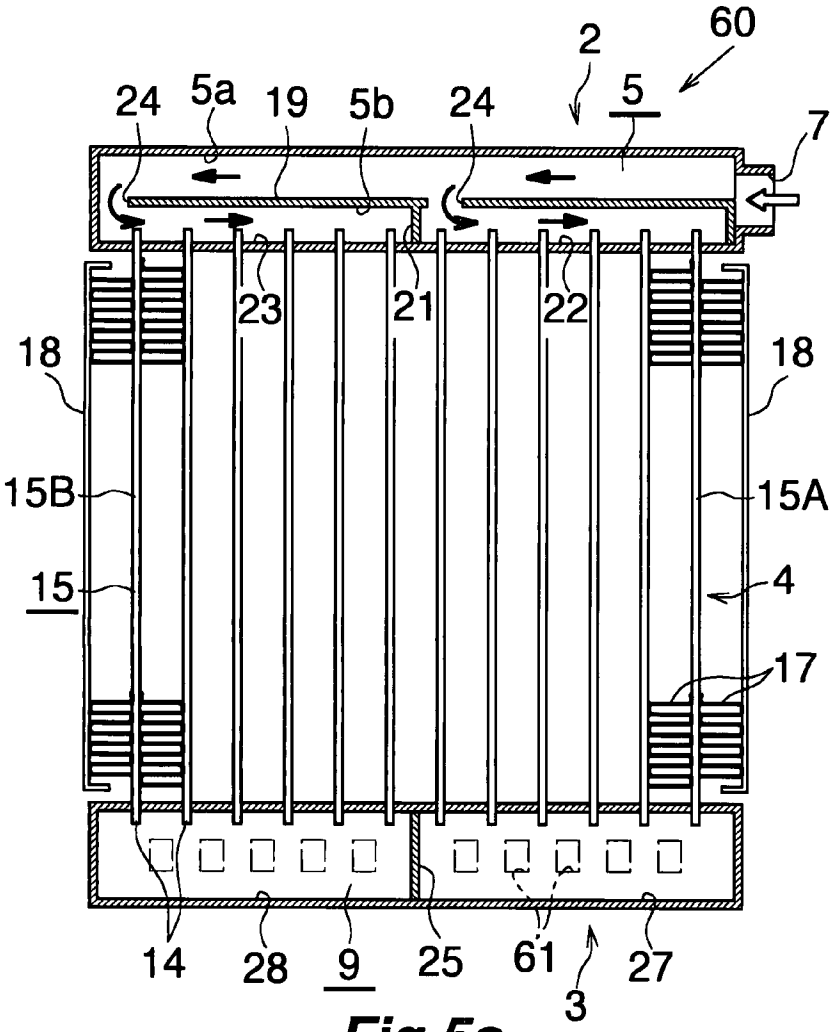
FIG. 5*a* is a view corresponding to FIG. 2*a* and showing the overall structure of a fourth embodiment of the evaporator to which the heat exchanger according to the present invention is applied.

The present embodiment is shown in FIGS. 5*a* and 5*b*, which show the entire structure of an evaporator.

In the case of the evaporator 60 shown in FIGS. 5*a* and 5*b*, the communication portions 32 and 33 are not provided on the opposite ends of the second header tank 3. Instead, at predetermined intervals in the left-right directions, a plurality of refrigerant passage holes 61 are formed in the partition wall 13, which divides the interior of the second header tank 3 into front and rear spaces, to thereby form the first intermediate header section 9 and the second intermediate header section 11. Accordingly, the refrigerant having flowed into the sections 27 and 28 of the first intermediate header section 9 flows into the sections 29 and 31 of the second intermediate header section 11 via the refrigerant passage holes 61.

Except for the above-described structural feature, the evaporator 60 is identical with the evaporator 1 of the first embodiment.

Figure 6:
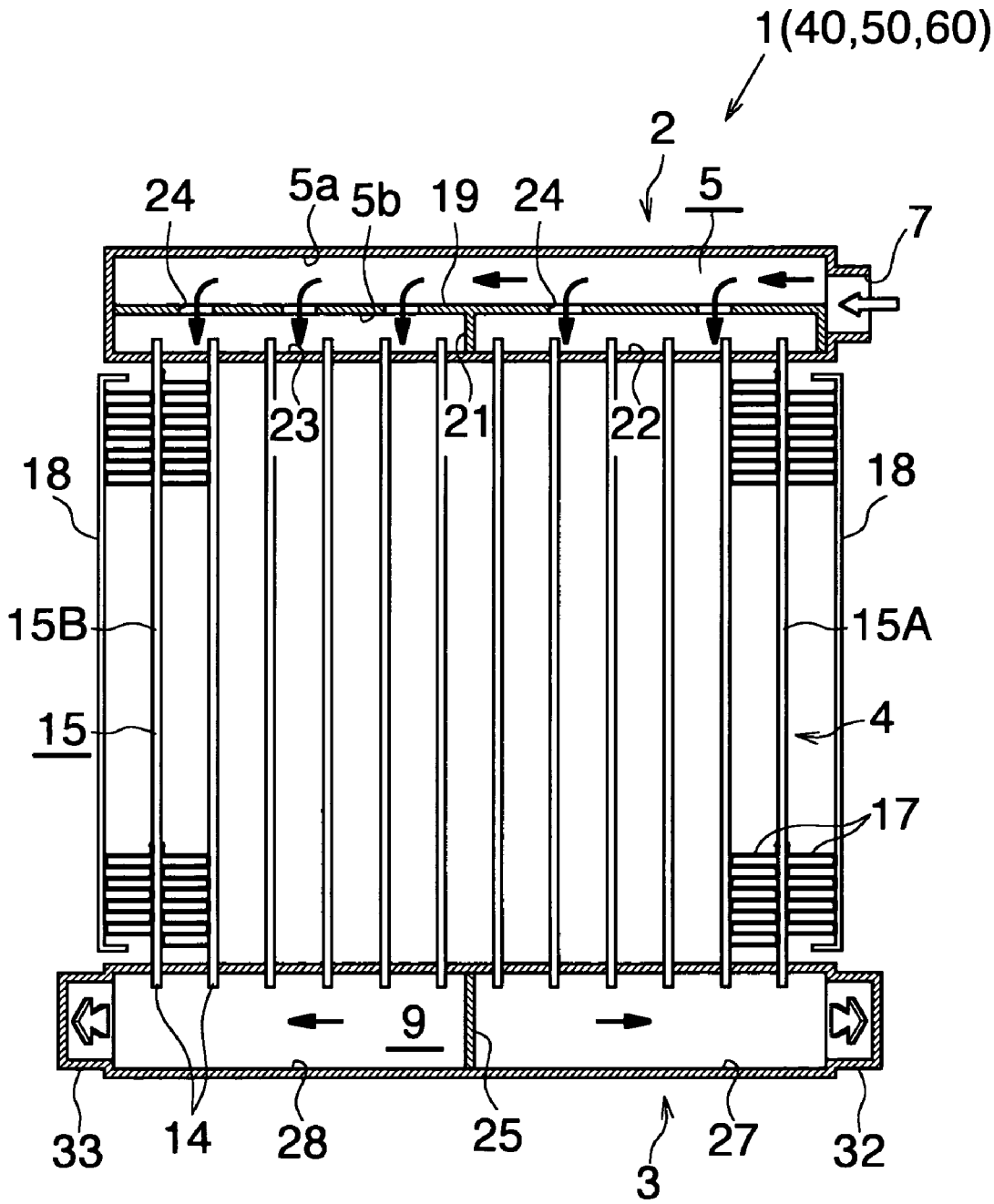
FIG. 6 is a view corresponding to FIG. 2*a* and showing a modification of the inlet header section of the first header tank.

FIG. 6 shows a modification of the refrigerant inlet header section 5 of the first header tank 2 used in the evaporators 1, 40, 50, and 60 of the first through fourth embodiments.

As shown in FIG. 6, at predetermined intervals in the left-right direction, a plurality of flow diverging means, each of which is constituted by a flow diverging opening 24 assuming the form of a through hole, are provided in each of portions of the first flow diverging plate 19, the portions facing the sections 22 and 23, so as to cause the refrigerant having flowed into the upper space 5*a* of the refrigerant inlet header section 5 to diverge into the sections 22 and 23. In the present embodiment, the number of the flow diverging openings 24 provided for the right-side section 22 close to the refrigerant inlet 7 is smaller than the number of the flow diverging openings 24 provided for the left-side section 23 located away from the refrigerant inlet 7. Thus, the amounts of refrigerant flowing into the right-side section 22 and the left-side section 23 are rendered uniform. In the case where the number of the flow diverging openings 24 provided for the right-side section 22 is equal to the number of the flow diverging openings 24 provided for the left-side section 23, the refrigerant having flowed from the refrigerant inlet 7 into the upper space 5*a* of the refrigerant inlet header section 5 more easily flows into the flow diverging openings in a region close to the refrigerant inlet 7, so that the refrigerant more easily flows into the right-side section 22.

What is claimed is:

1. A heat exchanger comprising first and second header tanks disposed apart from each other; and a plurality of heat exchange tubes are disposed between the header tanks and opposite end portions of the heat exchange tubes are connected to the corresponding header tanks, wherein the first header tank includes a refrigerant inlet header section and a refrigerant outlet header section juxtaposed in an air flow direction, the second header tank includes a first intermediate header section and a second intermediate header section juxtaposed in the air flow direction, and the heat exchange tubes establish communication between the refrigerant inlet header section and the first intermediate header section and communication between the refrigerant outlet header section and the second intermediate header section, wherein a portion of the interior of the refrigerant inlet header section, the portion communicating with the heat exchange tubes, is divided into a plurality of sections in a longitudinal direction of the header tanks; flow diverging means is provided in the refrigerant inlet header section so as to cause refrigerant having flowed into the refrigerant inlet header section to diverge into the sections; each of the interiors of the first intermediate header section and the second intermediate header section is divided into sections in the longitudinal direction of the header tanks, the number of the sections being equal to the number of the sections of the refrigerant inlet header section; the heat exchange tubes communicating with the sections of the refrigerant inlet header section communicate with the corresponding sections of the first intermediate header section; and the sections of the first intermediate header section communicate with the corresponding sections of the second intermediate header section.

2. The heat exchanger according to claim 1, wherein the interior of the refrigerant inlet header section is divided into two spaces in the longitudinal direction of the heat exchange tubes by an inlet header section flow diverging member; a first space of the refrigerant inlet header section located on a side toward the heat exchange tubes serves as the portion communicating with the heat exchange tubes; the first space is divided into a plurality of sections in the longitudinal direction of the header tanks by an inlet header section partition member; refrigerant flows into a second space of the refrigerant inlet header section located on a side opposite the heat exchange tubes; and flow diverging means composed of a flow diverging opening is provided in each of portions of the inlet header section flow diverging member corresponding to the sections of the first space so as to cause refrigerant having flowed into the second space of the refrigerant inlet header section to diverge into the corresponding spaces.

3. The heat exchanger according to claim 1, wherein each of the sections of the second intermediate header section of the second header tank is divided into two spaces in the longitudinal direction of the heat exchange tubes by a second intermediate header section flow diverging member, and communication is established between the two spaces of each section.

4. The heat exchanger according to claim 1, wherein the interior of the refrigerant outlet header section of the first header tank is divided into two spaces in the longitudinal direction of the heat exchange tubes by an outlet header section flow diverging member; a space of the refrigerant outlet header section located on a side toward the heat exchange tubes serves a portion communicating with the heat exchange tubes; the space located on the side toward the heat exchange tubes is divided into a plurality of sections in the longitudinal direction of the header tanks by an outlet header section partition member, the number of sections being equal to the number of sections of the refrigerant inlet header section; and the sections of the space located on the side toward the heat exchange tubes communicate with a space of the refrigerant outlet header section located on a side opposite the heat exchange tubes.

5. The heat exchanger according to claim 1, wherein each of the number of the sections of the refrigerant inlet header section of the first header tank, the number of the sections of the first intermediate header section of the second header tank, and the number of the sections of the second intermediate header section of the second header tank is two; the sections of the first intermediate header section and the second intermediate header section located on one side with respect to the longitudinal direction of the header tanks communicate with each other via a communication portion provided at one end of the second header tank; and the sections of the first intermediate header section and the second intermediate header section located on the other side with respect to the longitudinal direction of the header tanks communicate with each other via a communication portion provided at the other end of the second header tank.

6. The heat exchanger according to claim 1, wherein the interior of the second header tank is divided into two spaces in the air flow direction by a partition member so that the first intermediate header section and the second intermediate header section are formed; and refrigerant passage holes are formed in the partition member so as to establish communication between the first intermediate header section and the second intermediate header section.

* * * * *